US010792779B2

(12) United States Patent
Kosonen et al.

(10) Patent No.: US 10,792,779 B2
(45) Date of Patent: Oct. 6, 2020

(54) METHOD AND APPARATUS FOR INSTALLING ENDLESS ABRASIVE BELT

(71) Applicant: FLEXMILL OY, Nurmijärvi (FI)

(72) Inventors: Petri Kosonen, Lohja (FI); Marko Niemi, Revonlahti (FI); Tarmo Paldanius, Klaukkala (FI)

(73) Assignee: FLEXMILL OY, Nurmijärvi (FI)

( * ) Notice: Subject to any disclaimer, the term of this patent is extended or adjusted under 35 U.S.C. 154(b) by 363 days.

(21) Appl. No.: 15/944,992

(22) Filed: Apr. 4, 2018

(65) Prior Publication Data

US 2018/0290258 A1 Oct. 11, 2018

(30) Foreign Application Priority Data

Apr. 7, 2017 (EP) ..... 17165488

(51) Int. Cl.
*B24B 21/18* (2006.01)

(52) U.S. Cl.
CPC ..... *B24B 21/18* (2013.01)

(58) Field of Classification Search
CPC ..... B24B 21/18; B24B 21/20
See application file for complete search history.

(56) References Cited

U.S. PATENT DOCUMENTS 7,896,727 B2 * 3/2011 L'Helgoualc'h ..... B24B 9/00 451/11
2008/0173660 A1 * 7/2008 L'helgoualc'h ..... B24B 21/18 221/22

FOREIGN PATENT DOCUMENTS

| | | |
|---|---|---|
| EP | 1 946 888 | 7/2008 |
| JP | 5-8166 | 1/1993 |
| JP | 8-47849 | 2/1996 |
| JP | 4902852 | 3/2012 |

OTHER PUBLICATIONS

Search Report for EP17165488 dated Oct. 9, 2017, 2 pages.

* cited by examiner

*Primary Examiner* — Dung Van Nguyen
(74) *Attorney, Agent, or Firm* — Nixon & Vanderhye P.C.

(57) ABSTRACT

There is provided a method for installing an endless abrasive belt to a belt holder unit, the method comprising: aligning a base with the belt holder unit, the base comprising a backing plate and at least one belt extraction element extending from the backing plate, wherein a cartridge having a belt pre-tightened around the cartridge is physically coupled with the base such that there is a space between the backing plate and the cartridge; arranging the cartridge to face the belt holder unit; reducing said space by pressing the cartridge against the belt holder unit that causes the at least one belt extraction element to push said belt off around the cartridge as a response to reducing the space; and causing tightening of said belt to the belt holder unit.

16 Claims, 8 Drawing Sheets

METHOD AND APPARATUS FOR INSTALLING ENDLESS ABRASIVE BELT

This application claims priority to EP Patent Application No. 17165488.2 filed Apr. 7, 2017, the entire contents of which are hereby incorporated by reference.

FIELD

The present invention relates to belt grinding machines. More specifically, the present invention relates to solutions for installing abrasive belt to such machines.

BACKGROUND

Belt grinding machines are used in many different industrial applications. Different belts may need to be used and worn belts replaced. Hence, it may be beneficial to provide solutions making installing or replacing belts more effective.

BRIEF DESCRIPTION

According to an aspect, there is provided a method in an automated system for installing an endless abrasive belt to a belt holder unit of a belt grinding machine, the method comprising: aligning a base with the belt holder unit, the base comprising a backing plate and at least one belt extraction element extending from the backing plate, wherein a cartridge having an endless abrasive belt pre-tightened around the cartridge is physically coupled with the base such that there is a space between the backing plate and the cartridge; arranging the cartridge to face the belt holder unit such that the cartridge is situated between the backing plate and the belt holder unit; reducing said space by pressing the cartridge against the belt holder unit, wherein the reducing said space causes the at least one belt extraction element to exert force on said belt and push said belt off around the cartridge as a response to reducing said space; and causing tightening of said belt to the belt holder unit.

In an embodiment, the method further comprising: physically coupling the cartridge with the base by positioning the cartridge and the base against each other such that at least one guide protrusion of the base is at least partially situated in a corresponding at least one guide hole of the cartridge.

In an embodiment, the method further comprising: locking the cartridge to the base by closing a locking mechanism of the at least one guide protrusion and the at least one guide hole.

In an embodiment, the method further comprising: opening the locking mechanism; separating the cartridge and the base; and physically coupling another cartridge with the base.

In an embodiment, the base comprises at least two guide protrusions and the cartridge comprises corresponding at least two guide holes.

In an embodiment, the at least one belt extraction element extending from the backing plate is perpendicular to the backing plate.

In an embodiment, the base comprises at least two belt extraction elements arranged and dimensioned such that the cartridge moves between the at least two belt extraction elements as a response to reducing the space.

In an embodiment, the cartridge comprises at least one cavity corresponding to the at least one belt extraction element, the at least one cavity being situated at an edge area of the cartridge, said belt being pre-tightened at least partly over the at least one cavity, wherein the at least one belt extraction element is configured to move along the at least one cavity as a response to the reducing the space between the cartridge and the base.

In an embodiment, the method further comprising: causing increasing a distance between at least two belt pulleys of the belt holder unit in order to tighten said belt around the belt holder unit.

In an embodiment, the base is fixed to a belt-changing tool, the method further comprising: causing the belt-changing tool to fetch the cartridge from a storage area by physically coupling the base with the cartridge; and causing the belt-changing tool to move said base such that the cartridge faces the belt holder unit.

In an embodiment, the method further comprising: arranging the cartridge to face the belt holder unit by positioning the belt holder unit; pressing the belt holder unit against the cartridge in order to cause the at least one belt extraction element to exert force on said belt and push said belt off around the cartridge; and tightening said belt to the belt holder unit.

In an embodiment, the method further comprising: causing gripping, with a gripper, a belt installed to the belt holder unit; causing loosening said belt around the belt holder unit; and causing removing said belt from the belt holder unit.

According to an aspect, there is provided an apparatus comprising: at least one processor, and at least one memory comprising a computer program code which when executed by the at least one processor causes the apparatus at least to perform: causing aligning a base with the belt holder unit, the base comprising a backing plate and at least one belt extraction element extending from the backing plate, wherein a cartridge having an endless abrasive belt pre-tightened around the cartridge is physically coupled with the base such that there is a space between the backing plate and the cartridge; causing arranging the cartridge to face the belt holder unit such that the cartridge is situated between the backing plate and the belt holder unit; causing reducing said space by pressing the cartridge against the belt holder unit, wherein the reducing said space causes the at least one belt extraction element to exert force on said belt and push said belt off around the cartridge as a response to reducing said space; and causing tightening of said belt to the belt holder unit.

According to an aspect, there is provided a device for an automated system for installing an endless abrasive belt to a belt holder unit of a belt grinding machine, the device comprising: a cartridge; and an endless abrasive belt pre-tightened around said cartridge, wherein the cartridge is configured to be removably physically coupled with a base, comprising a backing plate and at least one belt extraction element extending from the backing plate, such that there is a space between the backing plate and the cartridge, and wherein reducing said space causes the at least one belt extraction element to exert force on said belt and push said belt off around the cartridge.

According to an aspect, there is provided a system comprising: one or more devices comprising: a cartridge, and an endless abrasive belt pre-tightened around said cartridge; an apparatus comprising: at least one processor, and at least one memory comprising a computer program code which when executed by the at least one processor causes the apparatus at least to perform: causing aligning a base with the belt holder unit, the base comprising a backing plate and at least one belt extraction element extending from the backing plate, wherein the cartridge having the endless abrasive belt pre-tightened around the cartridge is physically coupled with the base such that there is a space between the backing plate and the cartridge; causing arranging the cartridge to face the belt holder unit such that the cartridge is situated between the backing plate and the belt holder unit; causing reducing said space by pressing the cartridge against the belt holder unit, wherein the reducing said space causes the at least one belt extraction element to exert force on said belt and push said belt off around the cartridge as a response to reducing said space; and causing tightening of said belt to the belt holder unit.

Some embodiments are described in dependent claims.

BRIEF DESCRIPTION OF THE DRAWINGS

In the following the invention will be described in greater detail by embodiments with reference to the attached drawings, in which.

DETAILED DESCRIPTION OF SOME EMBODIMENTS

The following embodiments are exemplifying. Although the specification may refer to "an", "one", or "some" embodiment(s) in several locations of the text, this does not necessarily mean that each reference is made to the same embodiment(s), or that a particular feature only applies to a single embodiment. Single features of different embodiments may also be combined to provide other embodiments.

FIGS. 1A to 1D illustrate some sequences or steps used to install an endless abrasive belt 300 to a belt holder unit 400 of a belt grinding machine according to some embodiments. Reference is simply made to belt 300, but it needs to be understood that this belt 300 refers to an abrasive belt that is also endless. Endless may mean that the belt 300 has no ends, i.e. the belt 300 forms a loop. Sometimes belt 300 may be referred to as a strap or a band.

Said belt 300 may be used to grind or polish materials using the belt holder unit 400. Using the belt in such way causes wear, eventually causing the belt to be unable to perform its intended function or even break the belt. Hence, the belt 300 may need to be replaced with another belt (e.g. similar) or to be installed to a belt holder unit 400 at least once. It may also be beneficial to be able to change the belt 300 to a different kind of belt if a different functionality is needed. E.g. different belts may have different abrasive abilities, where roughness of the belt may vary. In any case, abrasive belt may be used to grind material using the belt holder unit 400.

Installing a belt may be time consuming and complex. Therefore, there is provided a solution for installing an endless abrasive belt 300 to a belt holder unit 400 of a belt grinding machine. Such solution may be applicable to an automated system for installing said belt. In some embodiments, the provided solution is suitable for replacing a belt. That is, installing said belt may comprise removing a previously installed belt and then installing the new belt to the belt holder unit 400. Let us look closer on the solution with reference to FIGS. 1A to 1D.

Figure 1A:
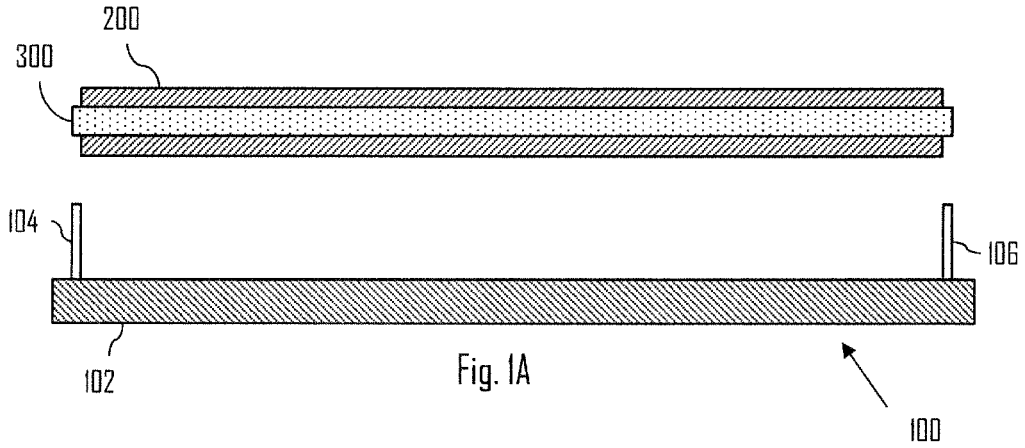
FIGS. 1A to 1D illustrate sequences of installing an endless abrasive belt to a belt holder unit of a belt grinding machine according to some embodiments.

Referring first to FIG. 1A, there is provided a cartridge 200. The cartridge 200 may have the endless abrasive belt 300 pre-tightened around said cartridge 200. In some embodiments, the cartridge comprises the belt 300. The belt 300 may be pre-tightened around an edge of said cartridge. Pre-tightening may cause the belt 300 to be in contact with the cartridge 200. This contact causes the belt 300 to stay around the cartridge. However, the belt 300 may be pushed off around the cartridge by inflicting a force to the belt.

There is provided a base 100 comprising a backing plate 102 and at least one belt extraction element 104, 106 extending from the backing plate 102. This can be seen in FIG. 1A, for example.

Figure 1B:
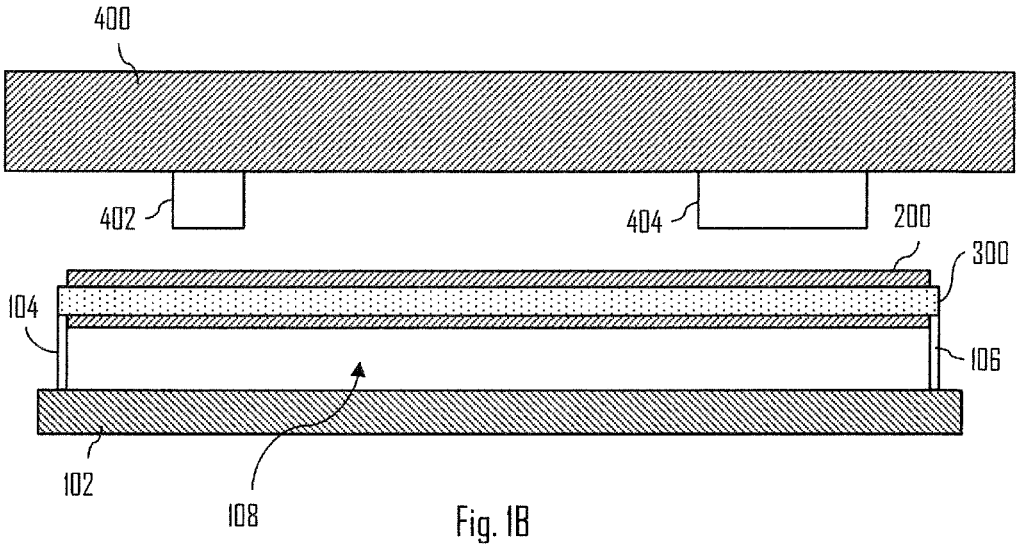

Referring now to FIG. 1B, the cartridge 200 and the base 100 may be configured to be physically coupled with each other. Further, in an embodiment, this physical coupling may be such that the two can also be separated (i.e. removable physical coupling). In other words, the cartridge 200 and the base 100 may be removably physically coupled to each other. This may, for example, enable a plurality of cartridges 200 to be used with only one base 100.

In FIG. 1B, the physical coupling may further be such that there is a space 108 between the backing plate 102 and the cartridge 200. The physical coupling may be achieved using a plurality of different methods. In one example, the cartridge 200 may be situated at least partially between at least two elements 104, 106 (i.e. belt extraction elements). In one example, additionally or alternatively, the belt 300 may lie on the at least one element 104, 106. Later, additional means for providing the coupling are also provided.

Still referring to FIG. 1B, the belt holder unit 400 is also shown. The belt holder unit 400 may be configured to receive the belt 300 from the cartridge 200. For example, the belt holder unit 400 may comprise at least one belt holder element 402, 404 to which the belt 300 may be attached to. For example, the belt holder element may comprise a first pulley 402 and a second pulley 404. The belt 300 may thus be installed to the belt pulleys 402, 404, for example. The pulleys 402, 404 may roll and thus enable the belt 300 to perform its grinding function.

Figure 1C:
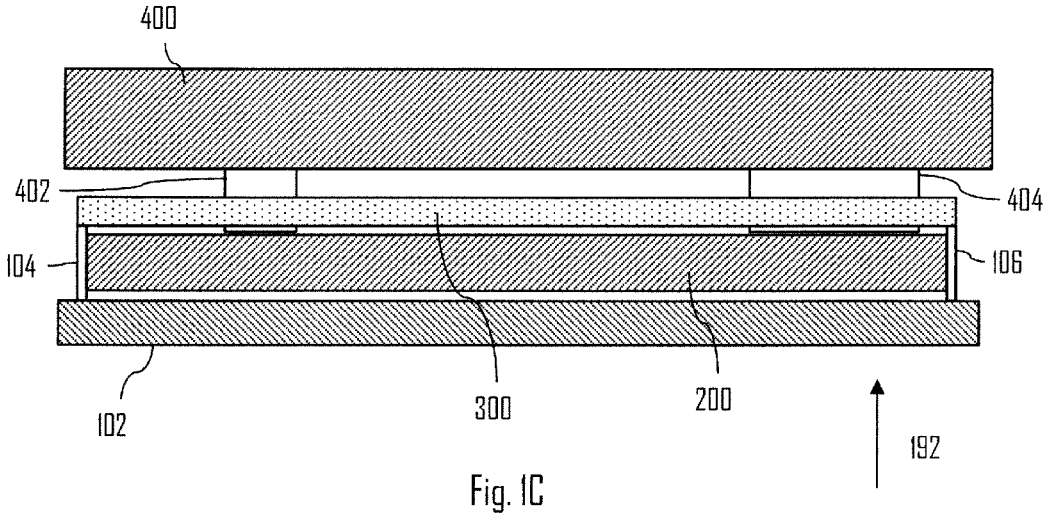

Referring to FIG. 1C, reducing space 108 (shown in FIG. 1B, but not in 1C) causes the at least one belt extraction element 104, 106 to push said belt 300 off around the cartridge 200. This may happen as the at least one belt extraction element 104, 106 may exert force on said belt 300. The belt 300 may still be pushed off around the cartridge 200 even though there would still be some space between the cartridge and the backing plate. In some embodiments, the space 108 is configured such that the distance between the backing plate 102 and the cartridge 200 equals or is greater than width of the belt 300.

Now, as the space 108 is reduced, for example, by pressing the cartridge 200 between the belt holder unit 400 and the base 100, the at least one element 104, 106 may push the belt 300 towards the belt holder unit 400. Hence, the belt 300 may thus be situated such that it is around the elements 402, 404, for example. In one example, the pressing is achieved by exerting a force having substantially the direction of an arrow 192 to the base 100. As the cartridge 200 physically touches the belt holder unit 400 (e.g. the elements 402, 404), the cartridge 200 may move towards the backing plate 102 hence reducing the space 108. Further, the element(s) 104, 106 may move towards the belt holder unit 400. Hence, as the element(s) 104, 106 may physically couple or be in contact with the belt 300, the belt 300 may be pushed towards the belt holder unit 400. Eventually, the belt 300 may be pushed off around the cartridge (as shown in FIG. 1C).

Now, to secure the belt 300 to the belt holder unit 400, the belt 300 may be tightened to the belt holder unit 400. One example of this can be seen in FIG. 1D, wherein the distance between the elements 402, 404 (e.g. two or more pulleys) is increased to tighten the belt 300. Increasing the distance may be indicated with an arrow 194. It may suffice that only one of the elements 402, 404 is move with respect to each other to increase the distance. However, in some embodiments, both are moved further from each other.

Figure 1D:
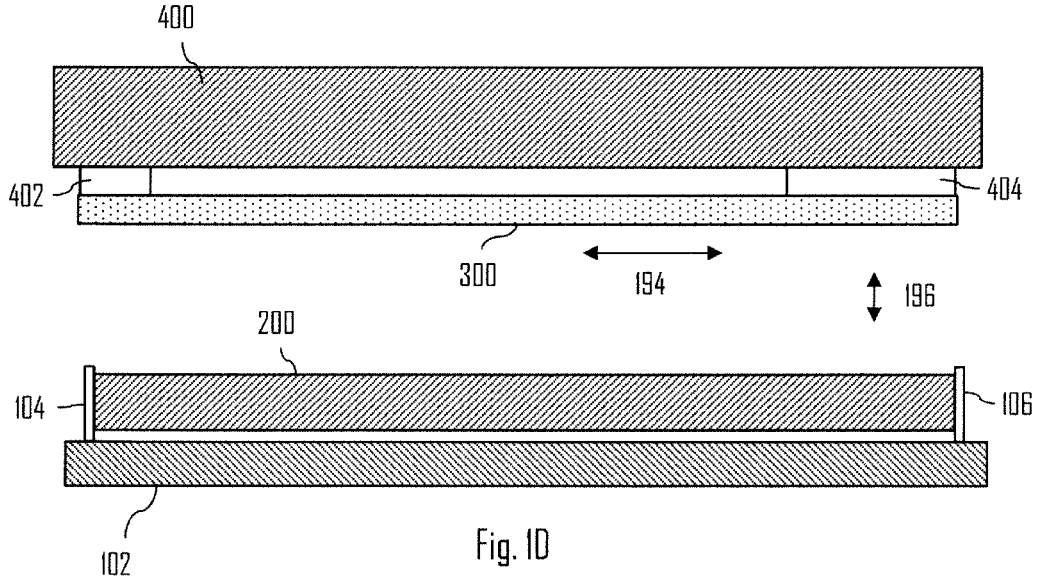

In an embodiment, in response to tightening the belt to the belt holder unit 400, the base 100 and the belt holder unit 400 may be separated from each other. This may be indicated with an arrow 196. For example, the cartridge 200 may now be pressed between the elements 104, 106. The cartridge 200 may be coupled with the base and thus removed together with the base 100. The separation may be performed by moving the base 100 and/or the belt holder unit 400. As a result, the belt 300 may be installed to the belt holder unit 400 as shown in FIG. 1D.

Figure 5:
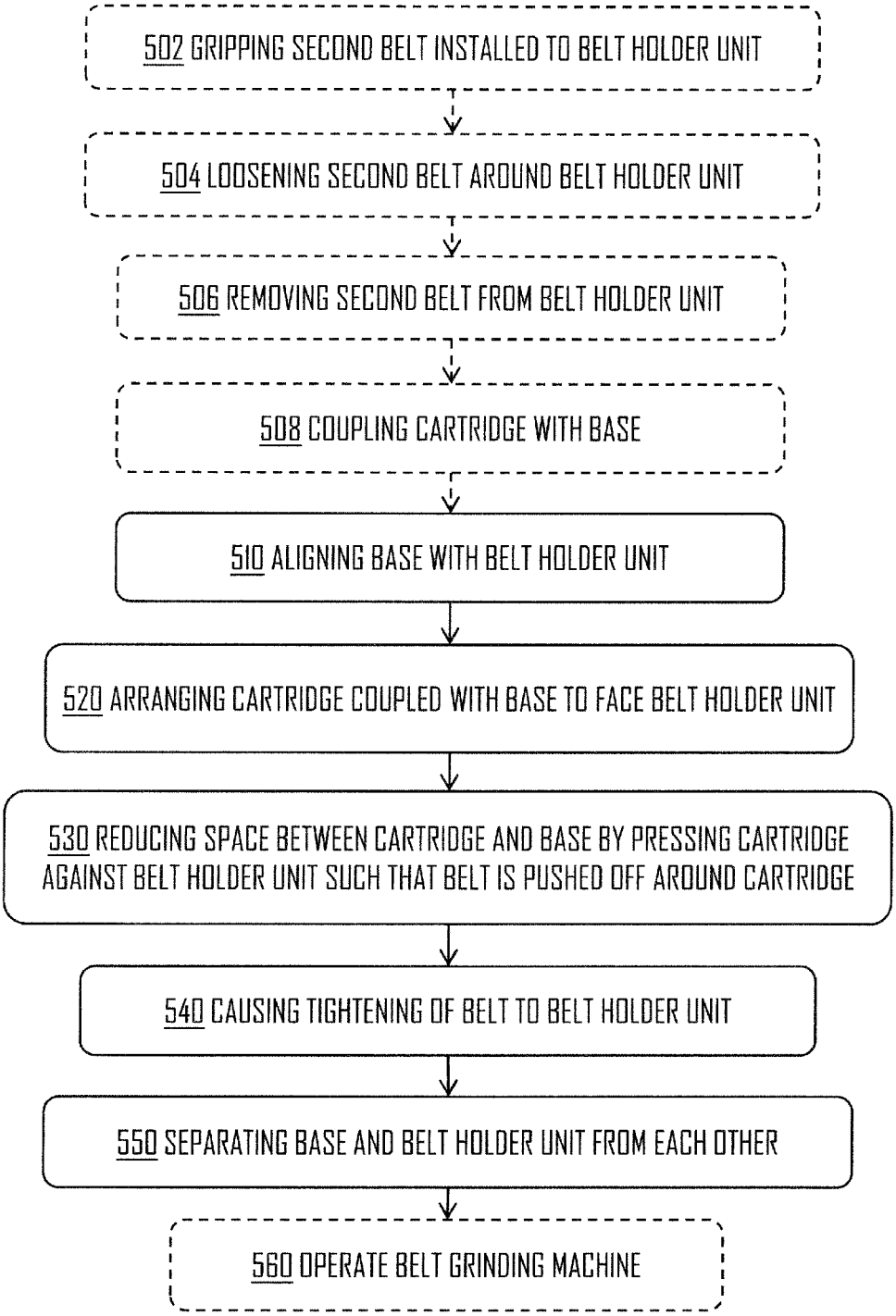
FIG. 5 illustrates a flow diagram according to some embodiments.

Let us then refer to FIG. 5 illustrating a flow diagram of a method according to some embodiments. The method may be performed by an automated system for installing an endless abrasive belt 300 to a belt holder unit 400 of a belt grinding machine, wherein the method comprises, according to an embodiment: aligning a base 100 with the belt holder unit 400, the base 100 comprising a backing plate 102 and at least one belt extraction element 104, 106 extending from the backing plate 102, wherein a cartridge 200, having an endless abrasive belt 300 pre-tightened around the cartridge 200, is physically coupled with the base 100 such that there is a space 108 between the backing plate 102 and the cartridge 200 (block 510); arranging the cartridge 200 to face the belt holder unit 400 such that the cartridge 200 is situated between the backing plate 102 and the belt holder unit 400 (block 520); reducing said space 108 by pressing the cartridge 200 against the belt holder unit 400 that causes the at least one belt extraction element 104, 106 to exert force on said belt 300 and push said belt 300 off around the cartridge 200 as a response to reducing the space 108 (block 530); and causing tightening of said belt 300 to the belt holder unit 400 (block 540). For example, the tightening may be caused by the belt holder unit 400 tightening said belt to the belt holder unit 400. Further, it may comprise transmitting a control signal or message, from the belt changing tool 10 to the belt grinding machine 40, wherein the control signal or message causes the belt to be tightened around the belt holder unit 400.

As described above, the method may further comprise separating the base 100 and the belt holder unit 400 from each other (block 550). For example, the base 100 may be removed from the area of the belt holder unit 400 by moving the base 100. In some examples, the belt holder unit 400 may be additionally or alternatively moved. In block 560, the belt grinding machine may be operated, wherein the belt 300 installed to said machine. In an embodiment, block 550 is performed after block 540. This may enable the belt 300 not to be misplaced (e.g. drop) before it is tightened to the belt holder unit 400.

In an embodiment, referring to FIG. 5, the method further comprises physically coupling the cartridge 200 with the base 100 (block 508). In some embodiment, the cartridge 200 and the base 100 may be pre-coupled to each other. However, it may be beneficial to be able to change the cartridge and thus it may also be beneficial to couple said two components together.

Figure 2A:
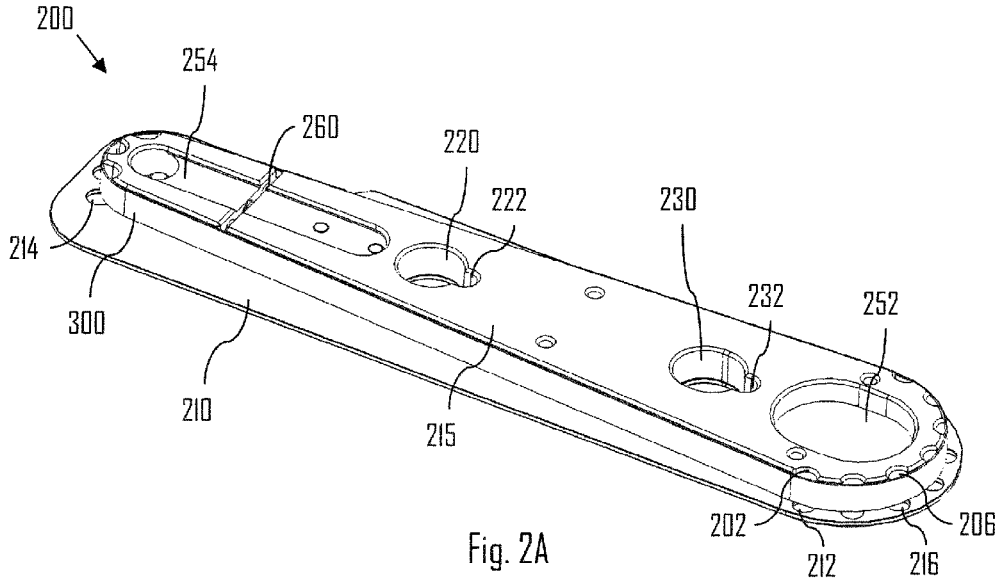
FIGS. 2A to 2B illustrate a cartridge for an endless abrasive belt according to some embodiments.
Figure 2B:
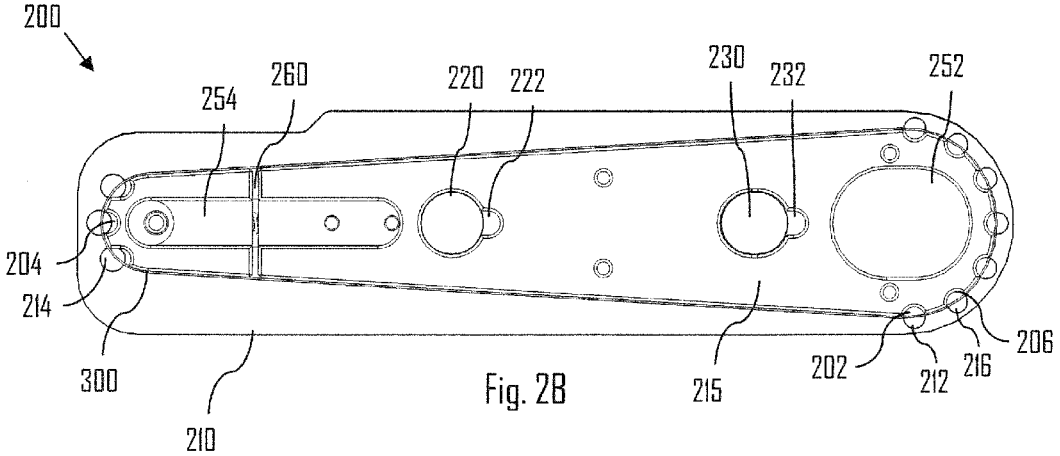
Figure 2C:
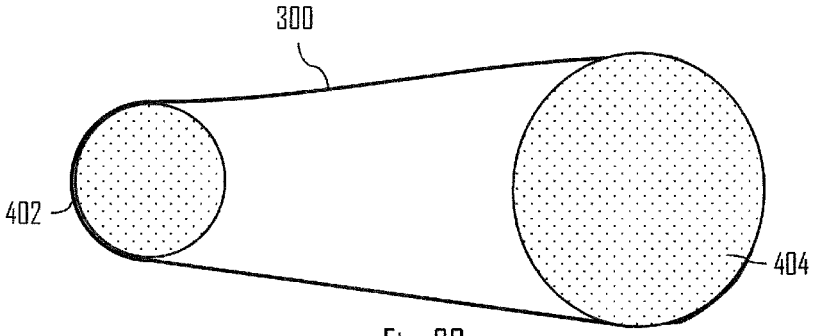
FIG. 2C illustrates an endless abrasive belt installed to a belt holder unit according to an embodiment.
Figure 2D:
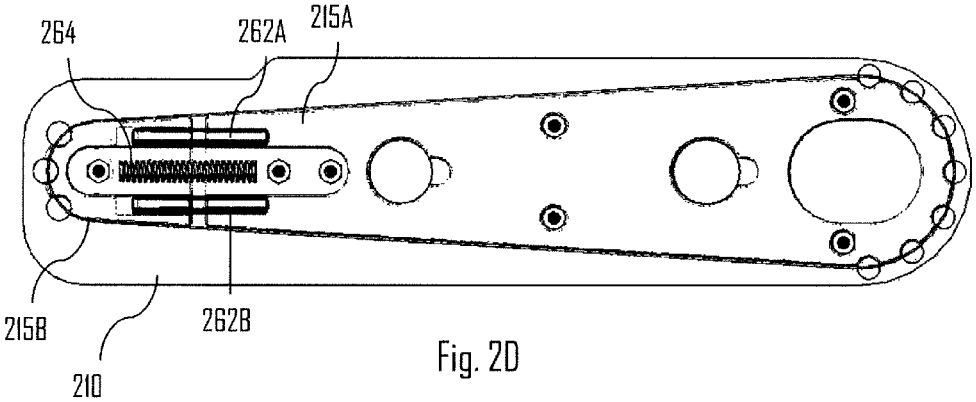
FIG. 2D illustrates an embodiment.
Figure 3A:
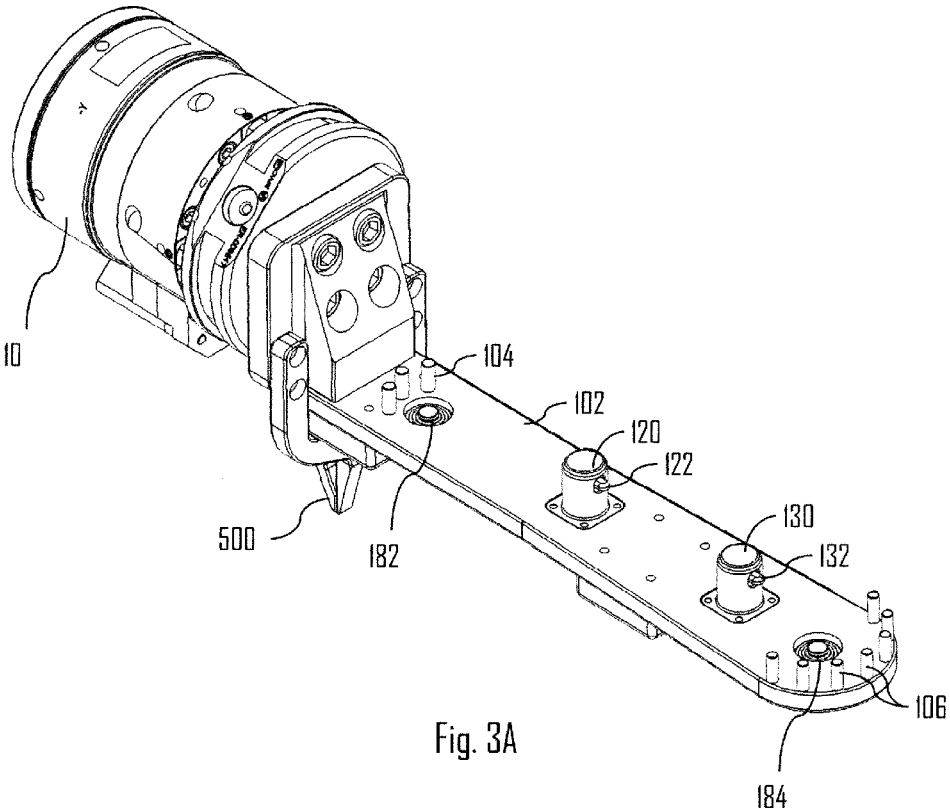
FIGS. 3A to 3B illustrate a base according to some embodiments.
Figure 3B:
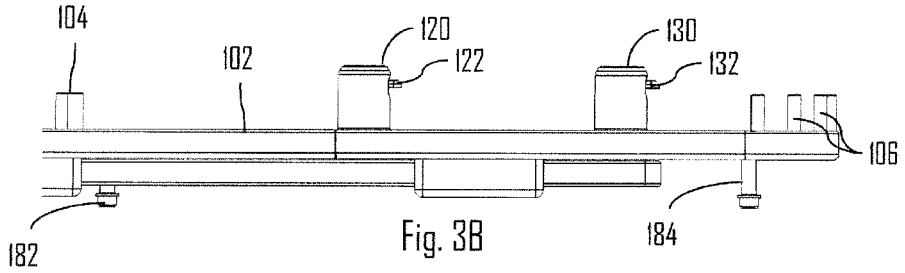
Figure 3C:
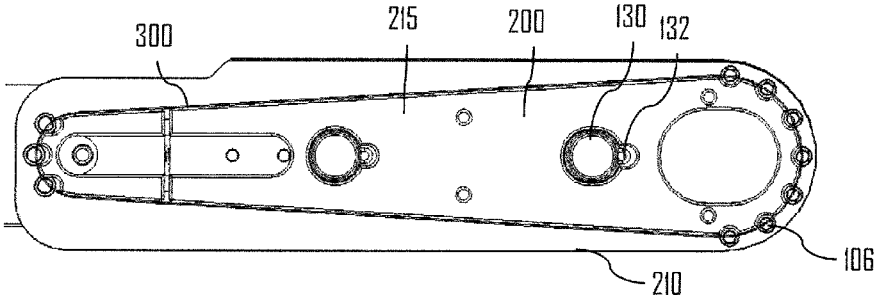
FIGS. 3C to 3D illustrate a base coupled with a cartridge according to some embodiments.
Figure 3D:
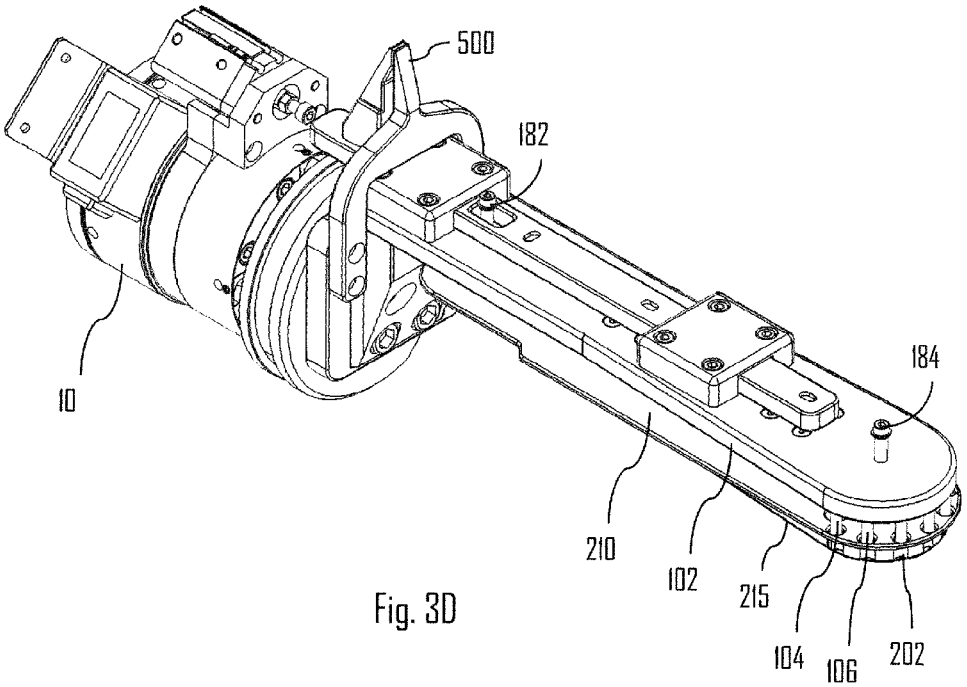

Let us then look closer on some embodiments and components of the provided solution. FIGS. 2A to 2B illustrate some embodiments of the cartridge 200. FIG. 2C illustrates an embodiment of the belt 300 installed to the belt holder unit 400 using at least two pulleys 402, 404. FIGS. 3A to 3B illustrate some embodiments of the base 100 and FIGS. 3C to 3D illustrate some embodiments in which the cartridge 200 is coupled with the base 100. Coupling in this case means physical coupling as explained above.

Referring to FIGS. 2A and 2B, the cartridge 200 is shown together with the belt 300 tightened around the cartridge 200. In an embodiment, the cartridge 200 comprises at least one guide hole 220, 230. The base 100 may comprise corresponding at least one guide protrusion 120, 130 shown, for example, in FIGS. 3A to 3B. This may mean that there may be a guide protrusion for each guide hole. Thus, the cartridge 200 and the base 100 may be coupled with each other by positioning the cartridge 200 and the base 100 against each other such that at least one guide protrusion 120, 130 of the base 100 is at least partially situated in a corresponding at least one guide hole 220, 230 of the cartridge 200. Thus, the two parts 100, 200 can be coupled with each other using the guiding means 120, 130, 220, 230. I.e. by placing the guide protrusion(s) 120, 130 into the guide hole(s) 220, 230, the coupling can be made such that the two parts 100, 200 are aligned to make the coupling more efficient and easy.

In an embodiment, the guide hole(s) 220, 230 are through hole(s). This may mean that they extend through the cartridge 200. However, a deep hole or cavity may suffice if it is dimensioned such that when the space 108 is reduced, the protrusion(s) 120, 130 do not hit the back wall of the hole(s) 220, 230.

In an embodiment, the base 100 comprises at least two guide protrusions 120, 130 and the cartridge 200 comprises corresponding at least two guide holes 220, 230. Using two or more guide protrusions and holes may further enhance the convenience of the physical coupling. In an embodiment, the guide holes 220, 230 are situated on different halves of the cartridge 200. Similarly, the protrusions 120, 130 may be situated on different halves of the backing plate 102.

According to an embodiment, the cartridge 200 and the base 100 are configured to be locked with each other using a locking mechanism 222, 232, 122, 132. For example, once the two parts 100, 200 are physically coupled with each other, said locking mechanism may be used to lock said two parts together. The locking mechanism may also be configured to be opened so that the two parts can be separated from each other. As one example, at least one of the guide protrusion 120, 130 (shown in FIGS. 3A to 3B) comprises a movable pin 122, 132. Said movable pin 122, 132 may also be referred to as a locking protrusion 122, 132. Corresponding guide hole 220, 230 may comprise a dent 222, 232 (also referred to as locking cavity) which may be configured to receive the pin 122, 132. In the examples of the Figures, two guide protrusion and holes are shown where each comprises either a pin or a dent. The dent(s) 222, 232 and pin(s) 122, 132 are may also be arranged other way around such that the dent(s) are comprised at the protrusion(s) 120, 130 and the pin(s) 122, 132 are situated at the guide hole(s) 220, 230.

The dent(s) 222, 232 may further be configured to extend the whole length of the hole(s) 220, 230. Thus, the pin may move in the dent when the space 108 is reduced. Hence, the dent(s) 222, 232 may be understood as bay(s) of the hole(s) 220, 230, for example. Thus, dent(s) may have the same depth (or be through holes) as the hole(s) 220, 230.

Referring to FIGS. 2A to 2B, the cartridge 200 may comprise a belt support 215, wherein the belt 300 may be tightened around an edge of the belt support 215. In an embodiment, the edge of the belt support 215 and the belt 300 have substantially same width. The cartridge 200 may comprise a back plane 210 (may be referred to as backing plate 210 of the cartridge 200). The cartridge 200 and the base 100 may be coupled with each other such that the back plane 210 may be situated between the belt support 215 and the backing plate 102 of the base 100. When the back plane 210 is used, the belt 300 may rest against the back plane 210 and/or at least the back plane 210 may prevent the extraction of the belt 300 to wrong direction. That is, the belt 300 may thus be removed only to the needed direction. The direction is evident from the shown Figures. If the hole(s) 220, 230 and the dent(s) 222, 232 are through holes, the holes may then extend through both the support 215 and the back plane 210.

Referring now to FIG. 2C, the once the belt 300 is extracted or pushed off around the cartridge (see FIGS. 1C and 1B), the belt may subsequently be tightened around the belt holder unit 400. One example of this is shown in FIG. 2C, wherein a distance between at least two belt pulleys 402, 404 of the belt holder unit 400 is increased in order to tighten said belt 300 around the belt holder unit 400 (i.e. around the belt pulleys 402, 404.

Referring to FIGS. 3A to 3B, some parts and embodiments were already discussed above. However, the at least one belt extraction element 104, 106 may now be seen in further detail. In an embodiment, the base 100 comprises a plurality of belt extraction elements 104, 106. In FIG. 3A total of 10 such elements are shown as an example. In an embodiment, the base 100 comprises at least two belt extraction elements 104, 106 arranged and dimensioned such that the cartridge 200 is at least partly positioned between the at least two belt extraction elements as a response to reducing the space 108. This can be seen, for example, in FIG. 1C and FIG. 1D, wherein the cartridge 200 is clearly between at least two elements 104, 106. Thus, the area defined between the at least two belt extraction elements 104, 106 may be same or slightly larger than an area defined by the outer dimensions of the belt 300 that has been pre-tensioned to the cartridge 200. Thus, the elements 104, 106 may situated facing or against the belt 300 when the cartridge 200 is coupled with the base 100.

In an embodiment, the at least one belt extraction element 104, 106 extending from the backing plate 102 is perpendicular to the backing plate 102. Similarly, the protrusion(s) 120, 130 may be perpendicular to the backing plate 102. Further, the protrusion(s) 120, 130 and the at least one belt extraction element 104, 106 may extend to the same direction. In an embodiment, the at least one belt extraction element 104, 106 acts also as a guiding element. Hence, specific guide protrusions may not be needed. However, using both may bring benefits to ease of use, for example.

Now, referring once again to FIGS. 2A to 2B, in an embodiment, the cartridge 200 comprises at least one cavity 202, 204, 206 corresponding to the at least one belt extraction element 104, 106. For example, there might be more extraction elements than said cavities, or there may be a cavity at the cartridge 200 for each belt extraction element. Using the cavity may bring the benefit of enabling the belt 300 to directly face the belt extraction element(s) 104, 106. The at least one cavity may be situated at an edge area of the cartridge 200 or the support 215. The belt 300 may be pre-tightened at least partly over the at least one cavity 202-206 as shown in FIGS. 2A to 2B. The at least one belt extraction element 104, 106 may further be configured to move along the at least one cavity 202-206 as a response to the reducing the space 108.

In an embodiment, the cartridge 200 comprises a plurality of cavities 202-206 spaced apart from each other. Thus, the edge of the support 215 may be at least partially toothed. Similarly, the extraction elements 104, 106 may be spaced apart from each other (e.g. 10 elements), wherein the spacing may correspond to the toothed edge of the support 215 such that the extraction elements may move along the cavities of the toothed edge.

In an embodiment, the back plane 210 further comprises a through hole 212, 214, 216 corresponding to each cavity 202, 204, 206. Thus, the extraction element(s) 104, 106 may extend through the back plane 210. The inner dimensions of the through hole(s) 212-216 may be substantially the same or larger than the outer dimensions the extraction element(s) 104, 106.

In an embodiment, the cartridge 200 comprises a control element 260 configured to enable changing outer dimensions of the belt support 215. For example, the support 215 may comprise two parts wherein the parts are adjustably attached to each other. This may mean that the distance between the two parts can be changed. This may enable increasing tolerance of belts (e.g. belt 300) pre-tensioned to the cartridge 200. E.g. if a belt loosely fits around the support 215, the control element 260 may be used to pre-tension the belt around the cartridge 200.

In an embodiment, the control element 260 comprises a spring member 264 (i.e. at least one spring). The control element 260 may further comprise one or more guide pins 262A, 262B. The spring member 264 may be situated between the guide pins 262A, 262B, for example. The spring member 264 may be configured to produce spring force to parts 215A and 215B such that the spring member 264 pushes said parts apart from each other. This may provide one way to pre-tension the belt 300 around the cartridge 200, and specifically the support 215, wherein the support comprises said parts 215A, 215B. So the spring member 264 may be used to pre-tension the belt 300 around the support 215. The parts 215A (e.g. the first part 215A) and 215B (e.g. the second parts 215B) may be configured to move with respect to the back plane 210 due to force exerted by the spring member 260.

Referring to FIG. 3C, a top view of the cartridge 200 on top of the base 100 may be shown. I.e. the cartridge 200 may be coupled with the base 100. Thus, the extraction element(s) 104, 106 (only 106 shown with reference sign) may be seen through holes in the back plane 210 (i.e. 212, 214, 216 not shown with reference signs). Similarly, the guide protrusion 130 may be seen through the cartridge 200 (e.g. through hole 230 not shown with reference sign). Thus, hole 220, 230 may extend through the back plane 210 and the support 215.

Referring to FIGS. 2A and 2B, cavities 252, 254 are shown. These cavities 252, 254 may correspond to the pulleys 402, 404 of the belt holder unit 400. That is, the cartridge 200 may comprise at least one cavity arranged and dimensioned such that a belt pulley 402, 404 fits into said cavity. Thus, the belt 300 may be brought even closer to the pulleys 402, 404 when the cartridge is pressed between the base 100 and the holder unit 400 to extract the belt 300 from the cartridge 200. The cavities 252, 254 may be formed, for example, by making through holes to the support 215, wherein the back plane 210 may act as a back wall for the cavities. However, the cavities may also be through holes. The main purpose may be to enable the pulley(s) 402, 404 to move within the cartridge 200 when the cartridge is pressed between the base 100 and the holder unit 400 as explained above. However, such cavities are not always needed, but may even further enhance the belt installment.

In an embodiment, the base 100 further comprises one or more spring-loaded rods 182, 184 shown in FIG. 3A (and also in FIG. 3B). In FIG. 3A, the spring-loaded rods 182, 184 are shown to be in down position, i.e. not extending upwards. However, the spring-loaded rods 182, 184 may be configured to extend to same direction as the guide protrusions 120, 130 and/or the extraction elements 104, 106. The spring-loaded rods 182, 184 may be configured to resist the cartridge 200 to move towards the base 100. As explained, such movement may cause the extraction elements 104, 106 to push the belt 300 off around the cartridge 200. However, such may not be needed or desired before the cartridge 200 is pressed between the belt holder unit 400 and the base 100. Hence, the spring-loaded rods 182, 184 may enable the space 108 not to be reduced (i.e. remain the same) before the pressing force exceeds a spring force caused by the spring-loaded rods 182, 184. In response to the exceeding the spring force caused by the spring loaded rods 182, 184, the space 108 may be reduced and thus the belt 300 extracted. Once the belt 300 has been removed off around the cartridge 200 and the belt installed to the belt holder unit 400, the pressing force can be stopped by removing the cartridge 200 from the belt holder unit 400. As the pressing force stops, the spring force generated spring-loaded rods 182, 184 may yet again push the cartridge 200 and thus the space 108 may be increased. As described above, the locking mechanism 222, 232, 122, 132 may prevent the cartridge 200 to be separated from the base 100 if the locking mechanism is engaged (i.e. is locked). Thus, the force generated by the spring-loaded rods 182, 184 may not cause the cartridge 200 and the base 100 to be separated if the pin(s) 122, 132 are in the dent(s) 222, 232 (i.e. the locking mechanism is locked). As shown in FIG. 3D, the spring-loaded rod(s) 182, 184 may be situated within an aperture or apertures of the backing plate 102. Thus, the rod(s) 182, 184 may be configured to move through said aperture(s).

In FIG. 3D, the cartridge 200 and the base 100 are shown upside down compared to FIG. 3C, i.e. cartridge 200 may be situated below the backing plate 102 in FIG. 3D. Such may be beneficial, for example, when installing the cartridge 200 to the base 100. In an embodiment, the base 100 is fixed to a belt-changing tool 10, as shown in FIGS. 3A, 3C and 4B, for example. Fixing may mean that the base 100 is irreversibly fixed to the tool 10 or that the fixing is removable. For example, the base 100 may be a part or be comprised in the tool 10.

According to an embodiment, with reference to FIG. 4B, at least one cartridge 200 (e.g. a plurality of cartridges) is stored in a storage area 480. The storage area 480 may be, for example, a shelf. However, some other type of storage area may be used. The storage area 480 may be situated, for example, on a wall. The storage area 480 may store a plurality of cartridges stored on top of each other, for example. The belt-changing tool 10 may be configured to fetch the cartridge 200 from the storage area 480 by physically coupling the base 100 with the cartridge 200. Further, once the cartridge is fetched, the belt-changing tool 10 may move said base 100 such that the cartridge 200 faces the belt holder unit 400. Subsequently, the cartridge 200 may be installed to the belt holder unit 400 as described above. The belt-changing tool 10 may be or comprise a robotic arm configured to perform the described actions. For example, the belt-changing tool 10 may be computer controlled. Thus, for example, computer program instructions may be configured to cause, when executed by a processing circuitry, the belt-changing tool 10 to perform any of the described functionalities or steps of the method. For example, the belt-changing tool 10 may perform steps of FIG. 5.

In an embodiment, after step 550, the belt-changing tool 10 is configured to move the cartridge 200 together with the base 100 to another storage area 490 shown in FIG. 4B. Thus, the empty cartridges may be arranged to the second storage area 490. For example, the cartridges 200 may be reusable.

Figure 4A:
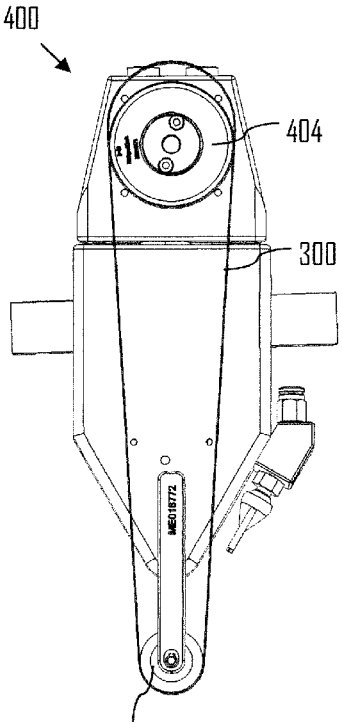
FIGS. 4A to 4C illustrate some embodiments.
Figure 4B:
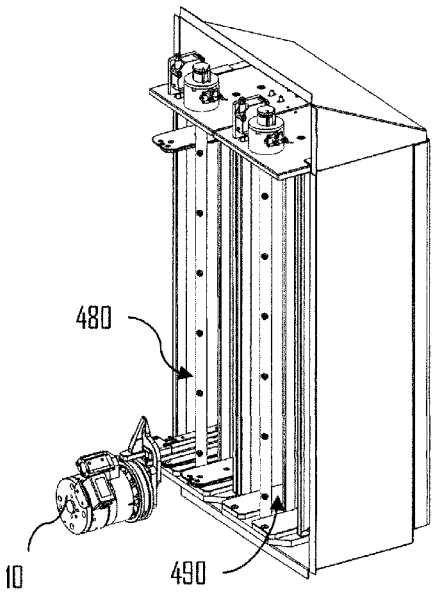
Figure 6:
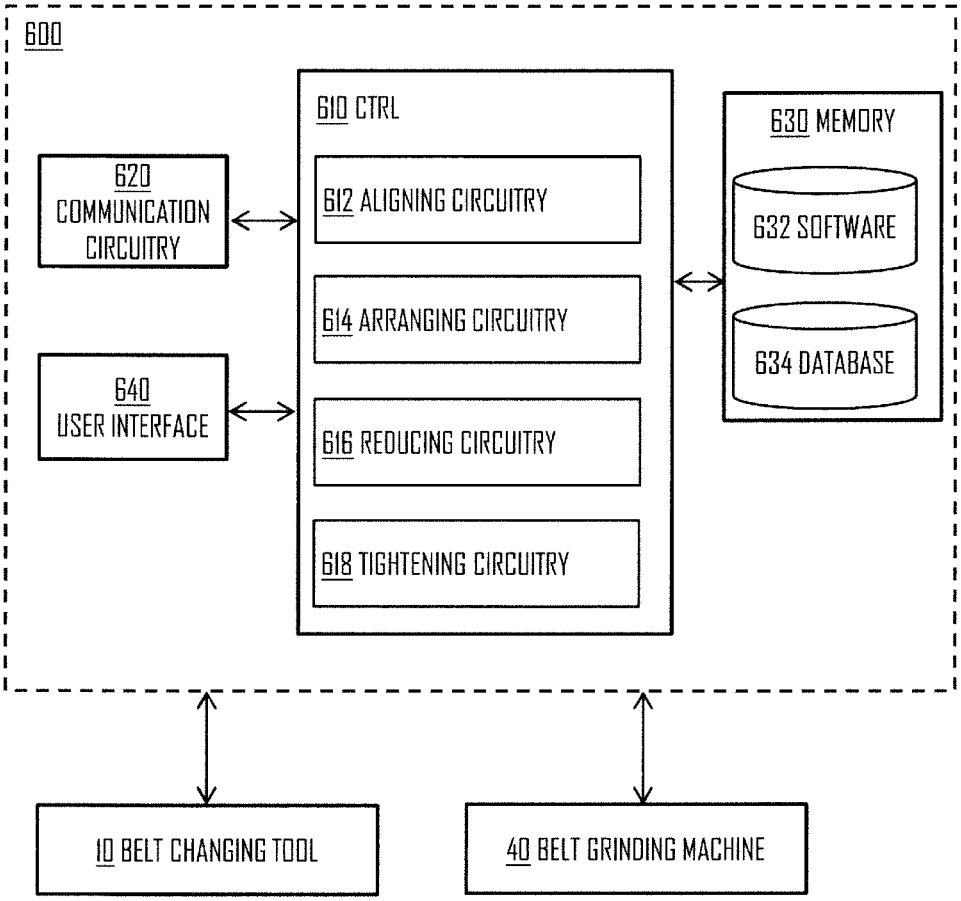
FIG. 6 illustrates a block diagram according to some embodiments.

In an embodiment, with reference to FIG. 4A, the belt holder unit 400 or the belt grinding machine may be configured to change position of the belt holder unit 400. For example, the belt holder unit 400 may be comprised in a robotic arm or similar computer controlled mechanism. The method may thus comprise: arranging the cartridge 200 to face the belt holder unit 400 by positioning the belt holder unit 400. I.e. belt holder unit 400 may be moved to face the cartridge 200. The cartridge 200 may, for example, be situated on a wall. For example, the cartridge 200 may already be coupled with the base 100. Thus, as the robotic arm of the belt grinding machine may be configured to press the belt holder unit 400 against the cartridge 200, such pressing may cause the at least one belt extraction element 104, 106 to exert force on said belt 300 and push said belt 300 off around the cartridge 200. Further, the belt may tightened to the belt holder unit 400 (e.g. around the pulleys 402, 404). Thus, in this embodiment, the belt grinding machine may be configured to perform the functions of the described method. This may be enable by use of a robotic hand of the belt grinding machine, wherein the robotic hand may move and position the belt holder unit 400 with respect to the cartridge 200 and/or cartridges. Furthermore, once the belt 300 has been installed, the robotic hand may move the belt holder unit 400 to an operation area that is different from the storage area of the cartridge 200. Hence, the belt grinding machine may continue its operation after the installment. The belt grinding machine may be referred to with reference sign 40 as shown in FIG. 6. Similarly, as with the belt-changing tool 10, the belt grinding machine 40 may be computer controlled.

Figure 4C:
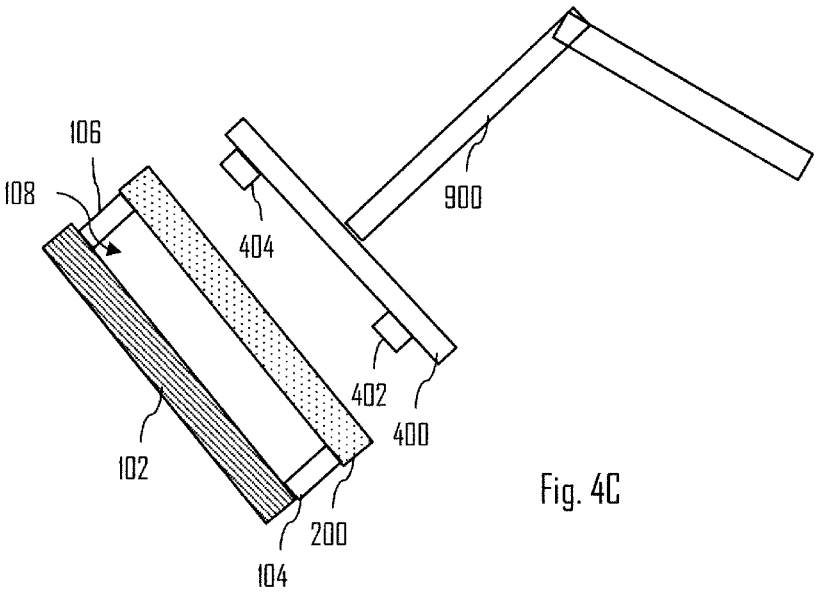

Referring to an embodiment shown in FIG. 4C, there is provided a robotic arm 900 that is operatively connected to the belt holder unit 400. That is, the robotic arm 900 may move the belt holder unit 400. Thus, the robotic arm 900 may be configured to move the belt holder unit 400 to face the cartridge 200 coupled with the base 100 as shown in FIG. 4C. The robotic arm 900 may further push the belt holder unit 400 against the cartridge 200 and the base 100 which causes the cartridge 200 to move towards the base (gap or space 108 is reduced). This causes the belt 300 to be removed around the cartridge 200, and hence the belt 300 may be installed to the belt holder unit 400, as indicated with various examples above. For example, the cartridge 200 coupled with the base 100 may be situated on a wall or on a table. For example, the cartridge 200 with the base 100 may be fixed to the wall or to the table. As described earlier, such robotic arm (e.g. robotic arm 900) may be part of the belt grinding machine. However, the robotic arm 900 may alternatively be a separate to the belt grinding machine.

In an embodiment, the system for changing the abrasive belt comprises both the belt-changing tool 10 and the belt grinding machine 40. In such case the belt-changing tool 10 may be configured to change or install the belt 300. However, alternatively or additionally, the belt grinding machine 40 may be configured to position the belt holder unit 400. This may happen also without the need to use the belt-changing tool 10. However, it may be beneficial to have both operations. Furthermore, in some embodiments, the belt holder unit 400 cannot be moved or does not comprise a robotic means to control its position. Thus, the belt-changing tool or similar tool may be beneficial.

The belt-changing tool 10 may comprise a gripper 500. Such tool is shown, for example, in FIG. 3D. The gripper may be configured to perform various tasks, including gripping a used belt from the belt holder unit 400, and separating it from the belt holder unit 400. I.e. the used or old belt may be disposed using the gripper 500. The gripper 500 may also be computer controlled similarly as the belt-changing tool 10.

In an embodiment, the belt-changing tool 10 is configured to grip a belt with the gripper 10, wherein the belt is installed to the belt holder unit 400 (block 502 of FIG. 5). The belt may be the belt 300 or another belt that needs to be removed before installing the belt 300, for example. The belt may be loosened around the belt holder unit 400 (block 504). For example, the belt-changing tool 10 may generate a control signal causing the belt grinding machine 40 to loosen the belt. In another example, both the belt-changing tool 10 and the belt grinding machine 40 are controlled by the same apparatus and thus said apparatus may cause both the actions of the belt-changing tool 10 and the belt grinding machine 40. After the belt has been loosened, the gripper 500 may be used to remove the belt from the belt holder unit 400 (block 506). Another belt, e.g. the belt 300, may then be installed to the belt holder unit 400.

In an embodiment, the gripper 500 is operatively connected to the locking mechanism 122, 132, 222, 232. For example, when the gripper 500 is in closed position (e.g. the gripper has gripped something), the locking mechanism 122, 132, 222, 232 may be in closed position. Similarly, when the gripper is in open position, the locking mechanism 122, 132, 222, 232 may be in open position. Both, the gripper 500 and the locking mechanism 122, 132, 222, 232 may be operated using, for example, hydraulic or pneumatic force. For example, when the gripper is closed, the movable pin may, in response, protrude from the guide protrusion 120 such that the locking mechanism is locked. Once the gripper 500 is opened, the movable pin 122 may return, in response, back within the guide protrusion 120. Closing the locking mechanism of the at least one guide protrusion and the at least one guide hole causes locking the cartridge 200 to the base 100. Locking may mean that the base 100 and the cartridge 200 cannot be removed from each other (i.e. temporarily irremovably connected to each other), but can still be pushed closer to each other in order to remove the belt 300 around the cartridge 200. However, once the locking is opened, the cartridge 200 may be removed from the base 100.

In an embodiment, the method further comprises opening the locking mechanism 122, 132, 222, 232; separating the cartridge 200 and the base 100; and physically coupling another cartridge with the base 100. Thus, another belt may be ready for installment. For example, when the belt-changing tool 10 is used to perform such operations, it may be beneficial that one belt-changing tool changes belts to more than one belt grinding machine 40. Hence, the system may comprise a plurality of belt-grinding machines 40.

FIG. 6 illustrates a block diagram of a system according to some embodiments. Referring to FIG. 6, the system may comprise a device, an apparatus, a part of a device or a part of an apparatus. Such are indicated with block 600 in FIG. 6. Reference is made to apparatus 600 although it needs to be understood that the apparatus 600 may be a part of some other apparatus, for example, the belt changing tool 10, robotic arm 900, or the belt grinding machine 40. In some embodiments, the apparatus 600 and its functionalities are shared between a plurality of different entities, e.g. between the belt changing tool 10 and the belt grinding machine 40. In an embodiment, the apparatus 600 is configured to cause performing of any of the embodiments and operations described above.

In an embodiment, the apparatus 600 comprises a controller 610 (CTRL). The CTRL may comprise aligning circuitry 612 configured to cause aligning the base 100 with the belt holder unit 400, an arranging circuitry 614 configured to cause arranging the cartridge 200 to face the belt holder unit 400 such that it is situated between the backing plate 102 and the belt holder unit 400, a reducing circuitry 616 configured to cause reducing said space 108 by pressing the cartridge 200 against the belt holder unit 400 that causes the at least one belt extraction element 104, 106 to exert force on said belt 300 and push said belt off around the cartridge 200 as a response to reducing the space, and a tightening circuitry 618 configured to cause tightening of said belt 300 to the belt holder unit 400. For example, if the apparatus 600 is comprised in the belt changing tool 10, the apparatus 600 may transmit a control signal (wired or wireless) to the belt grinding machine 40, wherein the signal causes the tightening the belt 300.

The apparatus 600 may further comprise a communication circuitry 620 configured to enable wireless and/or wired communication. For example, the communication circuitry 620 may be used to unidirectional or bidirectional communication. For example, the apparatus 600 may transmit a control signal causing the belt grinding machine to loosen the belt (e.g. for removing) or tighten the belt (e.g. for installing). In an embodiment, the communication circuitry 600 is configured to provide a communication link between the belt-changing tool 10 and the belt grinding machine 40. Thus, control information may be transmitted between the two. In such case the communication circuitry 620 is comprised in at least one of the belt-changing tool and the belt grinding machine 40. For example, the communication circuitry 620 may utilize one or more of the following technologies: Local Area Network (LAN), Wireless LAN (WLAN, sometimes referred to as WiFi), Bluetooth, Near Field Communication (NFC), and cellular communication.

The apparatus 600 may comprise a user interface 640 configured to enable interacting with the apparatus 600. For example, operational parameters of the belt-changing tool 10 and/or the belt grinding machine 40 may be changed using the apparatus 600.

In an embodiment, the apparatus 600 comprise at least one processor (e.g. CTRL 610 may denote at least one processor) and a memory 630 comprising a computer program code 632 (SOFTWARE) which when executed by the at least one processor causes the apparatus 600 to perform any of the functions or operations described above. For example, the software 632 may comprise instructions how to install the belt 300. The processor(s) may perform the computer program code. This may cause the apparatus 600 to perform the functions (e.g. if the apparatus 600 is part of the belt-chancing tool 10 or the belt grinding machine 40) or to cause one or more entities of the system to perform such functions.

In an embodiment, the memory 630 further comprises a database 634 for storing information.

The processes or methods described above may also be carried out in the form of a computer process defined by a computer program. That is, the computer program may be configured such that it causes an apparatus to perform the described functions. For example, the program may control operation of the belt holder unit 400, the belt chancing tool 10, the robotic arm 900. and/or the belt grinding machine 40. The computer program may be in source code form, object code form, or in some intermediate form, and it may be stored in some sort of carrier, which may be any entity or device capable of carrying the program. Such carriers include transitory and/or non-transitory computer media, e.g. a record medium, computer memory, read-only memory, electrical carrier signal, telecommunications signal, and software distribution package. Depending on the processing power needed, the computer program may be executed in a single electronic digital processing unit or it may be distributed amongst a number of processing units.

It further needs to be noted that the steps of FIG. 5 may be automated. I.e. the steps may be performed automatically by one or more described entities of the system.

According to an aspect, there is provided a device for an automated system for installing an endless abrasive belt to a belt holder unit of a belt grinding machine, said device comprising: a cartridge 200; and an endless abrasive belt 300 pre-tightened around said cartridge, wherein the cartridge is configured to be removably physically coupled with a base 100, comprising a backing plate 102 and at least one belt extraction element 104, 106 extending from the backing plate 102, such that there is a space 108 between the backing plate 102 and the cartridge 200, and wherein reducing said space 108 causes the at least one belt extraction element 104, 106 to exert force on said belt 300 and push said belt 300 off around the cartridge 200. In an embodiment, said device further comprises the base 100. According to an aspect, there is provided a system comprising one or more of said devices and the apparatus 600.

As used in this application, the term 'circuitry' refers to all of the following: (a) hardware-only circuit implementations, such as implementations in only analog and/or digital circuitry, and (b) combinations of circuits and software (and/or firmware), such as (as applicable): (i) a combination of processor(s) or (ii) portions of processor(s)/software including digital signal processor(s), software, and memory(ies) that work together to cause an apparatus (e.g. apparatus 600) to perform various functions, and (c) circuits, such as a microprocessor(s) or a portion of a microprocessor(s), that require software or firmware for operation, even if the software or firmware is not physically present. This definition of 'circuitry' applies to all uses of this term in this application. As a further example, as used in this application, the term 'circuitry' would also cover an implementation of merely a processor (or multiple processors) or a portion of a processor and its (or their) accompanying software and/or firmware.

The techniques and methods described herein may be implemented by various means. For example, these techniques may be implemented in hardware (one or more devices), firmware (one or more devices), software (one or more modules), or combinations thereof. For a hardware implementation, the apparatus(es) of embodiments may be implemented within one or more application-specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof. For firmware or software, the implementation can be carried out through modules of at least one chip set (e.g. procedures, functions, and so on) that perform the functions described herein. The software codes may be stored in a memory unit and executed by processors. The memory unit may be implemented within the processor or externally to the processor. In the latter case, it can be communicatively coupled to the processor via various means, as is known in the art. Additionally, the components of the systems described herein may be rearranged and/or complemented by additional components in order to facilitate the achievements of the various aspects, etc., described with regard thereto, and they are not limited to the precise configurations set forth in the given figures, as will be appreciated by one skilled in the art.

It will be obvious to a person skilled in the art that, as the technology advances, the inventive concept can be implemented in various ways. The invention and its embodiments are not limited to the examples described above but may vary within the scope of the claims.

The invention claimed is:

1. A method in an automated system for installing an endless abrasive belt to a belt holder unit of a belt grinding machine, the method comprising:

aligning a base with the belt holder unit, the base comprising a backing plate and at least one belt extraction element extending from the backing plate, wherein a cartridge having an endless abrasive belt pre-tightened around the cartridge is physically coupled with the base such that there is a space between the backing plate and the cartridge;

arranging the cartridge to face the belt holder unit such that the cartridge is situated between the backing plate and the belt holder unit;

reducing said space by pressing the cartridge against the belt holder unit, wherein the reducing said space causes the at least one belt extraction element to exert force on said belt and push said belt off around the cartridge as a response to reducing said space; and causing tightening of said belt to the belt holder unit.

2. The method of claim 1, further comprising:

physically coupling the cartridge with the base by positioning the cartridge and the base against each other such that at least one guide protrusion of the base is at least partially situated in a corresponding at least one guide hole of the cartridge.

3. The method of claim 2, further comprising:

locking the cartridge to the base by closing a locking mechanism of the at least one guide protrusion and the at least one guide hole.

4. The method of claim 3, further comprising:

opening the locking mechanism;

separating the cartridge and the base; and physically coupling another cartridge with the base.

5. The method of claim 2, wherein the base comprises at least two guide protrusions and the cartridge comprises corresponding at least two guide holes.

6. The method of claim 1, wherein the at least one belt extraction element extending from the backing plate is perpendicular to the backing plate.

7. The method of claim 1, wherein the base comprises at least two belt extraction elements arranged and dimensioned such that the cartridge moves between the at least two belt extraction elements as a response to reducing the space.

8. The method of claim 1, wherein the cartridge comprises at least one cavity corresponding to the at least one belt extraction element, the at least one cavity being situated at an edge area of the cartridge, said belt being pre-tightened at least partly over the at least one cavity, wherein the at least one belt extraction element is configured to move along the at least one cavity as a response to the reducing the space between the cartridge and the base.

9. The method of claim 1, further comprising:

causing increasing a distance between at least two belt pulleys of the belt holder unit in order to tighten said belt around the belt holder unit.

10. The method of claim 1, wherein the base is fixed to a belt-changing tool, the method further comprising:

causing the belt-changing tool to fetch the cartridge from a storage area by physically coupling the base with the cartridge; and causing the belt-changing tool to move said base such that the cartridge faces the belt holder unit.

11. The method of claim 1, further comprising:

arranging the cartridge to face the belt holder unit by positioning the belt holder unit;

pressing the belt holder unit against the cartridge in order to cause the at least one belt extraction element to exert force on said belt and push said belt off around the cartridge; and tightening said belt to the belt holder unit.

12. The method of claim 1, further comprising:

causing gripping, with a gripper, a belt installed to the belt holder unit;

causing loosening said belt around the belt holder unit; and causing removing said belt from the belt holder unit.

13. An apparatus comprising:

at least one processor, and at least one memory comprising a computer program code which when executed by the at least one processor causes the apparatus at least to perform:

causing aligning a base with the belt holder unit, the base comprising a backing plate and at least one belt extraction element extending from the backing plate, wherein a cartridge having an endless abrasive belt pre-tightened around the cartridge is physically coupled with the base such that there is a space between the backing plate and the cartridge;

causing arranging the cartridge to face the belt holder unit such that the cartridge is situated between the backing plate and the belt holder unit;

causing reducing said space by pressing the cartridge against the belt holder unit, wherein the reducing said space causes the at least one belt extraction element to exert force on said belt and push said belt off around the cartridge as a response to reducing said space; and causing tightening of said belt to the belt holder unit.

14. A device for an automated system for installing an endless abrasive belt to a belt holder unit of a belt grinding machine, the device comprising:

a cartridge; and an endless abrasive belt pre-tightened around said cartridge, wherein the cartridge is configured to be removably physically coupled with a base, comprising a backing plate and at least one belt extraction element extending from the backing plate, such that there is a space between the backing plate and the cartridge, and wherein reducing said space causes the at least one belt extraction element to exert force on said belt and push said belt off around the cartridge.

15. The device of claim 14, further comprising the base.

16. A system comprising:

one or more devices comprising: a cartridge, and an endless abrasive belt pre-tightened around said cartridge;

an apparatus comprising: at least one processor, and at least one memory comprising a computer program code which when executed by the at least one processor causes the apparatus at least to perform:

causing aligning a base with the belt holder unit, the base comprising a backing plate and at least one belt extraction element extending from the backing plate, wherein the cartridge having the endless abrasive belt pre-tightened around the cartridge is physically coupled with the base such that there is a space between the backing plate and the cartridge;

causing arranging the cartridge to face the belt holder unit such that the cartridge is situated between the backing plate and the belt holder unit;

causing reducing said space by pressing the cartridge against the belt holder unit, wherein the reducing said space causes the at least one belt extraction element to exert force on said belt and push said belt off around the cartridge as a response to reducing said space; and causing tightening of said belt to the belt holder unit.

* * * * *